United States Patent [19]

Vogt

[11] Patent Number: 4,850,018

[45] Date of Patent: Jul. 18, 1989

[54] SECURITY SYSTEM WITH ENHANCED PROTECTION AGAINST COMPROMISING

[75] Inventor: William R. Vogt, Rockaway, N.J.

[73] Assignee: Baker Industries, Inc., Parsippany, N.J.

[21] Appl. No.: 880,984

[22] Filed: Jul. 1, 1986

[51] Int. Cl.[4] ..... H04K 9/00

[52] U.S. Cl. ..... 380/23; 380/30; 380/52; 340/505; 340/506; 340/522; 340/534; 340/825.52

[58] Field of Search ..... 178/22.08, 22.09, 22.07, 178/22.13, 22.17; 340/825.52, 825.75, 505, 506, 531, 534, 522; 380/23-25, 37, 43, 48

[56] References Cited

U.S. PATENT DOCUMENTS

| | | | |
|---|---|---|---|
| 4,005,428 | 1/1977 | Graham | 340/825.75 |
| 4,025,760 | 5/1977 | Trenkamp | 380/25 |
| 4,093,946 | 6/1978 | Fowler | 340/534 |
| 4,139,737 | 2/1979 | Shimada et al. | 340/825.52 |
| 4,264,782 | 4/1981 | Konheim | 380/25 |
| 4,326,098 | 4/1982 | Bouricius et al. | 380/25 |
| 4,369,332 | 1/1983 | Campbell, Jr. | 178/22.07 |
| 4,401,976 | 8/1983 | Stadelmayr | 340/522 |
| 4,550,311 | 10/1985 | Galloway et al. | 340/531 |
| 4,550,312 | 10/1985 | Galloway et al. | 340/534 |
| 4,645,871 | 2/1987 | Bremer et al. | 380/29 |

OTHER PUBLICATIONS

"A Method for Obtaining Digital Signatures and Public-Key Cryptosystems", Rirest et al., Communications of the ACM, Feb. 1978, vol. 21, #2.

*Primary Examiner*—Stephen C. Buczinski
*Assistant Examiner*—Bernarr Earl Gregory
*Attorney, Agent, or Firm*—James J. Jennings

[57] ABSTRACT

A security system for a protected premise has a controller which receives data, over a pair of line conductors, from the addressed transponder of a series of addressable transponders located within the protected premise and connected across the line. To enhance the security of the system and to prevent compromising, the data is sent to the controller in coded form that changes from time to time in accordance with a secret code schedule. A decoding or decrypting system in the controller operates in accordance and in step with the same secret code schedule to decode the received coded data to recover the original information. The coded data may represent an encrypted signature of the addressed transponder which signature is decrypted to check the validity of the replying transponder. As another example, the coded information sent back on the line conductors may relate to a particular condition monitored by the transponder, such as the state of a transducer that detects or indicates that a burglary or robbery is occurring, so that an unauthorized person cannot determine that particular condition merely by reading the data appearing on the line. Without the secret code schedule, the coded data on the line is useless.

11 Claims, 5 Drawing Sheets

TRANSPONDER

STATE TABLE

| H | J | K | L | M |
|---|---|---|---|---|
| 0 | 0 | 0 | 0 | 1 |
| 1 | 0 | 0 | 0 | 1 |
| 1 | 1 | 0 | 0 | 1 |
| 1 | 1 | 1 | 0 | 0 |
| 0 | 1 | 1 | 1 | 1 |
| 1 | 0 | 1 | 1 | 1 |
| 1 | 1 | 0 | 1 | 0 |
| 0 | 1 | 1 | 0 | 0 |
| 0 | 0 | 1 | 1 | 1 |
| 1 | 0 | 0 | 1 | 0 |
| 0 | 1 | 0 | 0 | 1 |
| 1 | 0 | 1 | 0 | 0 |
| 0 | 1 | 0 | 1 | 0 |
| 0 | 0 | 1 | 0 | 0 |
| 0 | 0 | 0 | 1 | 0 |
| 0 | 0 | 0 | 0 | 1 |

| J | K | OUTPUT WAVEFORM SELECTED FOR NORMAL (77) | ALARM (78) |
|---|---|---|---|
| 0 | 0 | Q | R |
| 0 | 1 | R | S |
| 1 | 0 | S | T |
| 1 | 1 | T | Q |

SECURITY SYSTEM WITH ENHANCED PROTECTION AGAINST COMPROMISING

BACKGROUND OF THE INVENTION

This invention relates to a security system, of the type that monitors a series of transponders located in an area or premise to be secured, having enhanced protection against unauthorized tampering and compromising.

Security systems, which constitute data communication systems, have been developed wherein a controller monitors, and receives data over a pair of line conductors from, remote parallel-connected transponders each of which is located within the same protected premise. The term "transponder" signifies a unit which can control and/or monitor some condition and/or associated component, such as a transducer, which may or may not be adjacent to its physical location and which may or may not be within its physical enclosure. A transponder may be selectively addressed by the controller and recognizes not only its address but other information which may be transmitted from the controller, such as command signals for controlling the operation of the transponder itself and/or various associated devices, such as relays, visual and/or audible indicators, or any other device. In addition, the transponder itself may transmit information, such as the transducer response or status or any other data, back to the controller.

A transducer, associated with a transponder, may take any one of a wide variety of different forms. For example, a transducer may be an intrusion detector such as an ultrasonic space detector or an infrared space detector that detects movement within a given area, or an unauthorized entry sensor such as a reed switch actuated by a magnet (usually used on windows and doors), window tape in the form of metal foil which breaks if a window is broken, or a wire running through a screen which is cut when the screen is ripped. A transducer could also be a physical switch, such as a "holdup button" in a bank which may be manually actuated by a bank employee if a robbery occurs. The transducer could also constitute a transistor switch that is operated by some device to detect some alarm condition or state. Moreover, fire and smoke detection may also be included in the security system for the protected premise, in which case a transducer would take the form of a fire or smoke detector.

Data communication systems, which may function as security systems, are disclosed in U.S. Pat. Nos. 4,394,655, 4,470,047 and 4,507,652, and in U.S. patent application Ser. No. 716,799, filed Mar. 27, 1985, which issued Apr. 14, 1987, as U.S. Pat. No. 4,658,249, and Ser. No. 832,624, filed Feb. 25, 1986, which are assigned to the present assignee. In these patents and applications, the teachings of which are incorporated herein by reference, a controller communicates with a series of individually addressable transponders, located within the same protected premise, by sending successive composite signals, each comprising a group of pulses, over a two-wire distribution system. High-amplitude portions of a composite signal or pulse group are employed to transmit commands from the controller, while low-amplitude portions are used to return information from the addressed transponder to the controller.

Preferably, a security system for a protected premise should be immune to unauthorized tampering and compromising so that the security achieved by the system is not neutralized. For example, it should not be possible for a burglar or robber to defeat the security by breaking into the system and substituting a "bogus" transponder for a legitimate or valid one to avoid producing an alarm signal. Such a bogus transponder would provide a false indication to the controller that nothing is wrong and that conditions are normal, even though an unauthorized entry sensor, associated with the substituted transponder, may have been tripped. It is important for the controller to "know" if a valid transponder has been substituted with a similar transponder or any other device designed to respond like the substituted transponder. In addition, it is desirable that the security system function in such a way that an unauthorized person will not be able to tell, from the output of a transponder, whether an alarm has been triggered. When a "silent" alarm is employed, it is usually preferred that knowledge of that alarm actuation be withheld from the robber or burglar in order to allow time for law enforcement personnel to arrive.

The present invention achieves significantly greater protection against unauthorized tampering and compromising than that realized in the prior security systems. Furthermore this is accomplished at relatively little cost and requires very little space to implement. Among the very desired results obtained by the present invention, replacing of a transponder with a bogus one, or even with a computer, will not compromise the security and will be detected. Moreover, observation of the output of a transponder will not reveal whether an alarm has been actuated by that transponder. This is achieved in the present invention by encrypting or coding the data sent from each of the transponders, located within a protected premise or area, to the controller. In the past, for high security protection encryption has been employed in the communication link that leaves the controller, and its protected premise, and couples to a remote central station. Such prior systems, however, are not adaptable to the coding of the data from the individual transponders.

SUMMARY OF THE INVENTION

The security system of the invention includes a controller for receiving data over a pair of line conductors from a plurality of addressable transponders monitored by the controller and coupled across the line conductors within the same protected premise. Each of the transponders comprises encrypting means, operable when the transponder is addressed by the controller, for sending to the controller coded data the form of which varies from time to time in accordance with a predetermined secret code schedule. The controller is provided with decrypting means which operates in accordance and in step with the same predetermined secret code schedule to decode the received coded data.

In accordance with a more detailed aspect of the invention, a composite signal, divided into successive time segments and having a pulse in each segment, is transmitted from the controller to an addressed transponder which modifies the pulse in at least one selected segment of the composite signal, to provide the coded data, and returns that modified segment to the controller. The coded data may constitute coded identifying data representing an encrypted signature of the addressed transponder, which signature changes each time the coded data changes. The decrypting means in the controller decodes the coded identifying data and decrypts the signature in order to determine or check the validity of the replying transponder to make certain that it is not bogus or counterfeit. On the other hand, the coded data may serve as coded transducer information representing the state or condition of a transducer associated with the addressed transponder, the decrypting means decoding the coded transducer information to determine the state of the transducer. With the transducer data appearing in coded form on the line conductors, there is no way that an unauthorized person can determine the transducer state merely by observing the information on the line.

DESCRIPTION OF THE DRAWINGS

The features of the invention which are believed to be novel are set forth with particularity in the appended claims. The invention may best be understood, however, by reference to the following description in conjunction with the accompanying drawings, wherein like reference numerals identify like components, and in which:

GENERAL BACKGROUND AND SYSTEM DESCRIPTION

Figure 1:
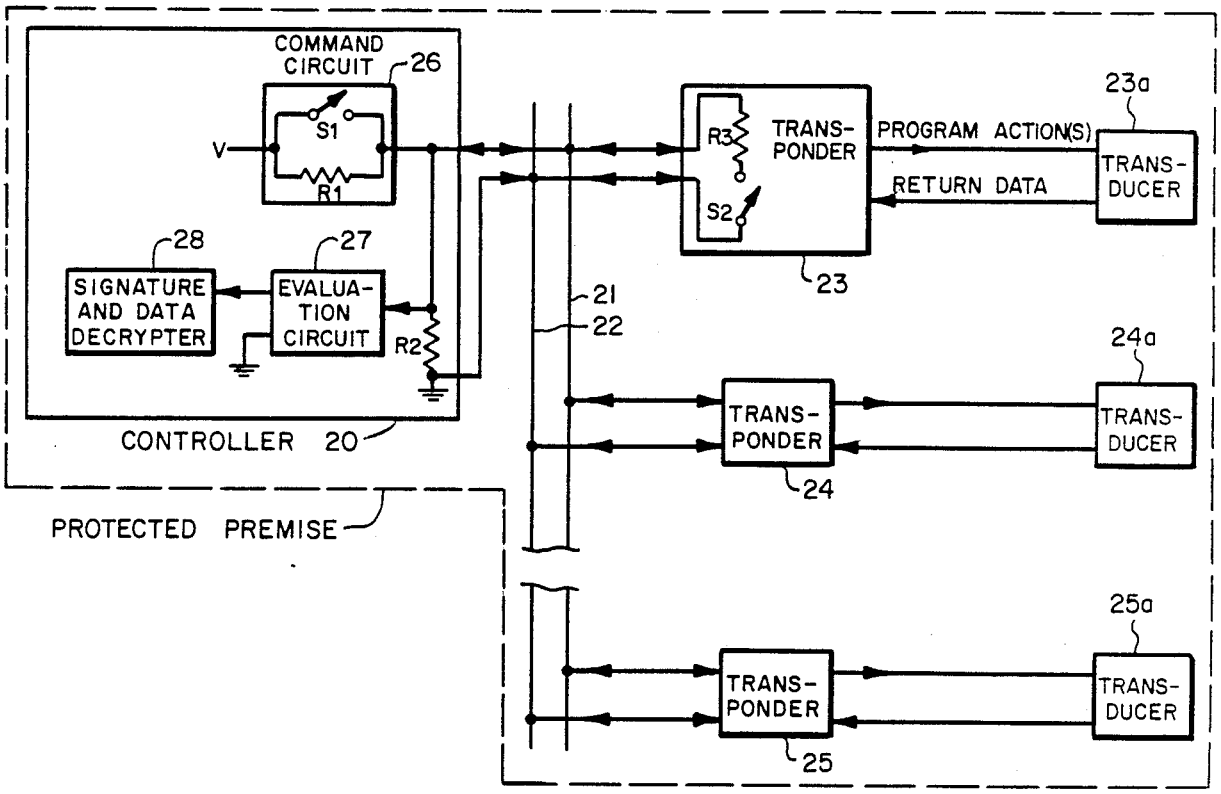
FIG. 1 is a block diagram of a security system, for a protected premise, in the form of a bidirectional data communication system generally similar to the system disclosed in the aforementioned U.S. patents and patent applications but modified in accordance with the present invention.

FIG. 1 depicts the data communication arrangement of the earlier system, described in the aforementioned U.S. patents and patent applications, modified to achieve a high degree of secrecy in accordance with the present invention. There, a controller 20 sends and receives data over a pair of conductors 21, 22, to which a plurality of transponders 23, 24 and 25 are coupled. Each transponder 23, 24, 25 connects to an associated respective one of transducers 23*a*, 24*a*, 25*a*. Only three transponders and associated transducers are shown but it will become apparent that large numbers of transponders can communicate with controller 20 over the same conductor pair, and thus over the same local multiplex loop. As indicated by the dashed construction line, controller 20 as well as all of the transponders and transducers are located within the same protected premise. Controller 20 includes a command circuit 26 having a switch S1 coupled in parallel with a resistor R1. One side of this parallel combination is coupled to a reference voltage V, and the other side is coupled both to conductor 21 and to the input of evaluation circuit 27. Another resistor R2 is coupled between the input to circuit 27 and a ground plane of reference potential, to which conductor 22 is also coupled. As shown in transponder 23, typically each transponder includes a resistor R3 coupled in series with a switch S2, and this combination is coupled across line conductors 21, 22 as shown. When switch S1 in the controller is closed, a voltage V is applied over conductors 21, 22 to the various transponders. When switch S1 is opened, and all the switches S2 remain open, the voltage divider circuit comprising resistors R1 and R2 provides a voltage of V/2 at the input to evaluation circuit 27. Preferably, all the resistors R1, R2 and R3 are of equal value. Thus, with a voltage of V/2 on the line, and when switch S2 is then closed, resistor R3 is placed in parallel with resistor R2, and a voltage V/3 appears at the input of evaluation circuit 27. Command circuit 26 regulates the opening and closing of switch S1 and each closure is used to send commands to the respective transponders, which then perform the commanded action. Electrical power for operating the transponders is also sent when switch S1 is closed, each transponder having a capacitor which is maintained in a charged condition by voltage V to provide an operating potential. Each transponder can return data from itself and/or from associated equipment, such as a transducer that responds to unauthorized entry to a secured area, by closure of switch S2 when switch S1 is open. A detailed explanation of such system operation is set out in the U.S. patents and patent applications identified above. Block 28 has been added to the controller 20 in FIG. 1 to implement the present invention. The function of block 28 will be described later.

Figure 2:
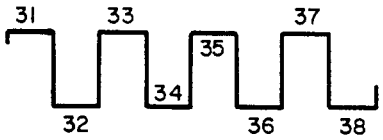
FIG. 2 is a graphical illustration of a composite signal for representing data as taught in the cited U.S. patents and patent applications.

The closing and opening of switches S1 and S2 can produce a composite signal which includes or is divided into successive time segments as shown in FIG. 2. These different time segments include the high-amplitude portions 31, 33, 35 and 37 (when switch S1 is closed), and the low-amplitude portions 32, 34, 36 and 38 when switch S1 is open. In the referenced U.S. patents and patent applications the high-amplitude portions are utilized to transmit commands to the different transponders, and the low-amplitude portions are employed to return data from a selected addressed transponder to the controller. The duration of closure of switch S1 is variable and can be recognized at a transponder, as can the number of times switch S1 is opened and closed in a group of pulses, namely during a single composite signal. This facilitates the addressing of a selected transponder. When an addressed transponder is responding or answering back to the controller, a voltage V/2 received at the evaluation circuit 27 indicates that the transponder's switch S2 is open, whereas a voltage V/3 signifies that the transponder's switch S2 is closed. Controller 20 derives information from the particular transponder replying by analyzing the time duration of S2 closure, or the time duration of voltage V/3 appearing across the line conductors.

DETAILED DESCRIPTION OF THE INVENTION

While the inventive concept is explained as implemented in connection with a bidirectional data communication system of the type taught in the patents and patent applications noted above, it will be readily understood by those skilled in the art that the present invention has much wider application. For example, and as will be appreciated, it is not even necessary that command data or any data be sent to a transponder. It is merely necessary that data be transmitted from a transponder to the controller.

Figure 3:
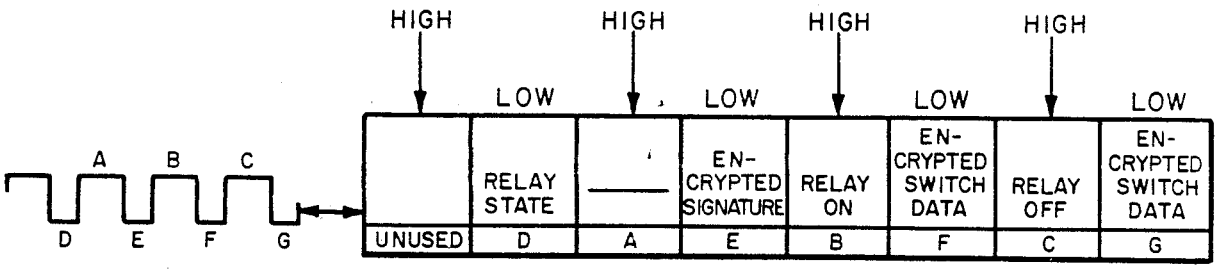
FIG. 3 is a graphical illustration and an accompanying operation table which help to understand the operation of the present invention.

FIG. 3, which includes a waveform on the left and a tabulation on the right, depicts a composite signal with successive time segments representing different data, and is similar to the pulse group shown in FIG. 2. The high and low pulses in the composite signal on the left in FIG. 3 are designated by the letters A–G and the various data in the time segments defined by those pulses are illustrated in the tabulation on the right over the corresponding letters. With the exception of the data labeled "encrypted signature" and "encrypted switch data" occuring during the low-amptitude pulses E, F and G, the indicated data is typical of the types of command data given to an addressed transponder and the information returned from the transponder during a single composite signal in accordance with the teachings of the aforementioned U.S. patents and applications. The information conveyed during pulses, or time segments, E, F and G is developed according to the present invention and will be explained later. As indicated in the tabulation, the first high pulse in FIG. 3 does not necessarily signify any command. The first low pulse, designated D, may be used to instruct the addressed transponder to return information concerning the status of an associated relay. The second high pulse, labeled A, is not used in this illustration. The third and fourth highs, designated B and C, respectively, are commands to turn the relay on and off.

Figure 5:
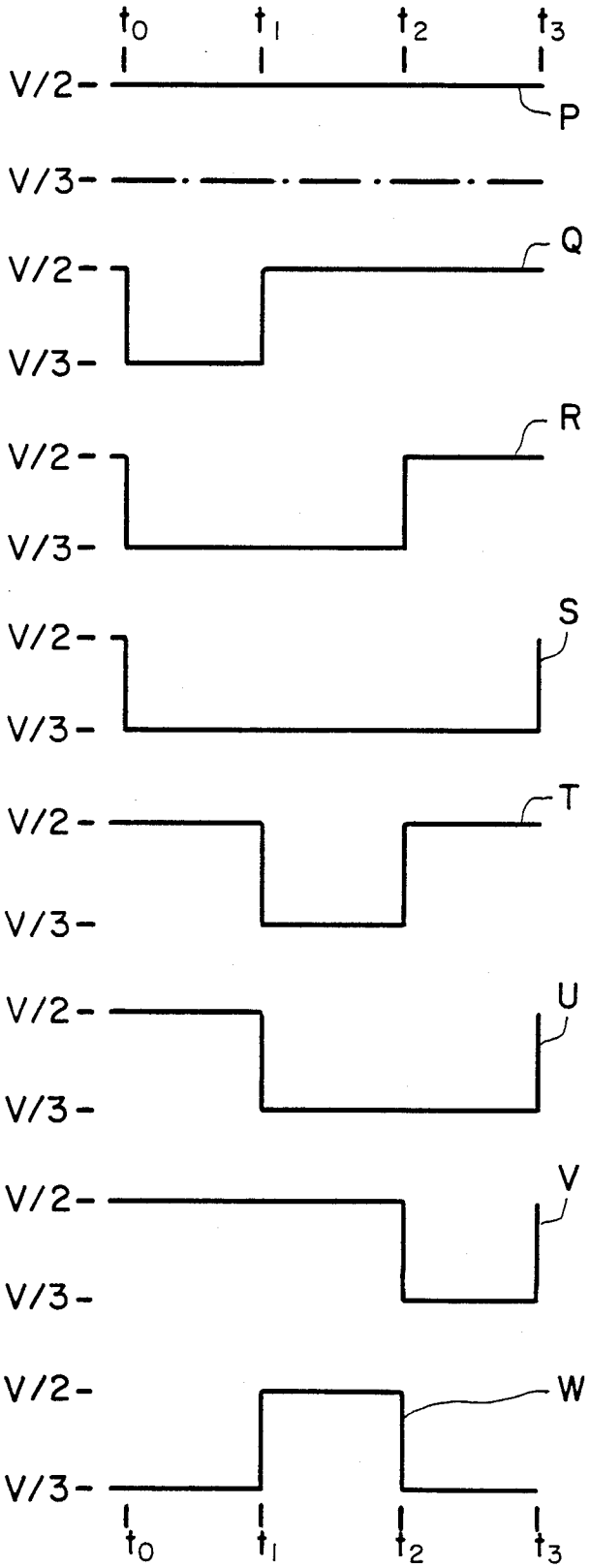
FIG. 5 shows a series of waveforms helpful in understanding the operation of the invention.

During each of the pulse lows (namely, during segments D, E, F and G), information may be returned to the controller in the form of a selected one of the eight waveshapes shown in FIG. 5. Of course, those skilled in the art will appreciate that other waveforms are possible in order to include more bits or portions of data. These eight different response signals (labeled with the letters P–W in FIG. 5) are developed in the transponder, as taught in the cited prior patents and applications, by a psuedo-binary system in which the signal interval or time segment is divided into three portions, starting at $t_0$. The first portion terminates at time $t_1$, the second at time $t_2$, and the third ends at time $t_3$. More specifically, waveform P illustrates a data return signal in which a response is provided from a transponder by keeping its switch S2 (which is preferably a transitor switch) open, and the voltage across the line conductors high at V/2, for the entire time segment. The second response signal (waveform Q) goes low (S2 closed) for the first portion, the voltage across the line thereby being V/3, and remains high for the second and third portions. The next reply signal (waveshape R) goes low for the first two portions and then goes high and remains high for the third portion. Waveform S goes low at time $t_0$ and remains low throughout the response interval. Response signal T remains high for the first portion, is low for the second portion, and is again high for the third portion. In waveform U the first portion is high and the second and third are low. The response is high for the first two portions of waveform V and then goes low for the third portion of that pulse. Response signal W remains low for the first portion, goes high at time $t_1$ and remains high for the second portion, after which the signal goes low at time $t_2$ and remains there during the third portion.

Figure 4:
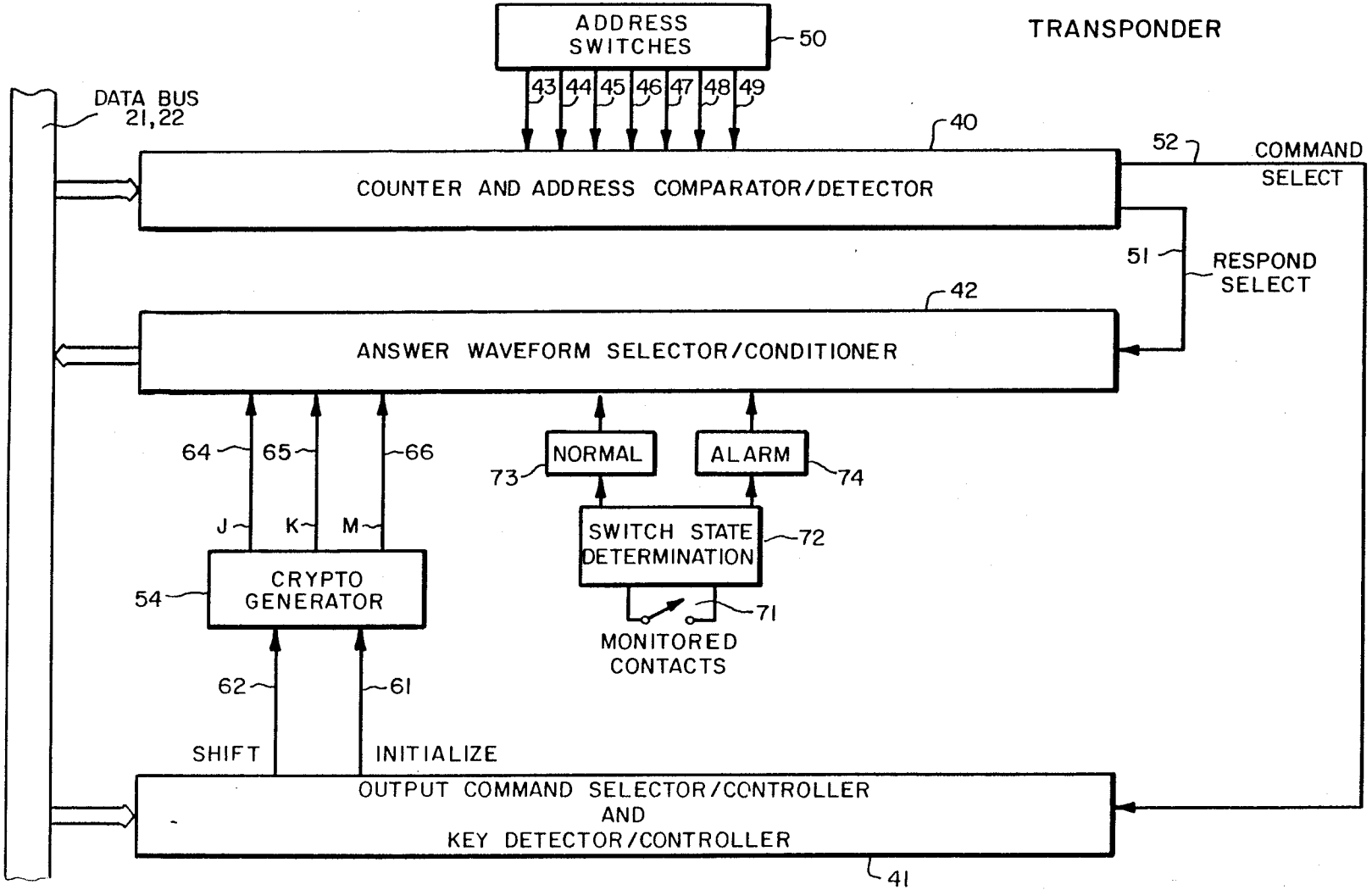
FIG. 4 is a block diagram of a transponder constructed to implement the present invention.

FIG. 4 depicts the general layout of one transponder suitable for implementing the system of the invention in the illustrated embodiment. Of course, some elements of the transponder have not been shown in FIG. 4 to avoid unduly encumbering the drawing. Reference is made to the above noted patents and patent applications for a more detailed disclosure. FIG. 4 shows the manner in which the prior system is modified in order to practice the present invention, and only the essential elements are illustrated. Data bus 21, 22 can be a pair of line conductors as described above in connection with FIG. 1, a coaxial cable, or any other suitable passage for signals, electrical, optical or otherwise. It is also understood that the transponders need not be physically connected, as by a solid, low-resistance electrical connection, but there can be intermediate transmission through the air or other medium without departing from the data transmission and recognition concept of the present invention.

In the illustrated embodiment, data received from the controller over bus 21, 22 is passed into counter and address comparator/detector 40, and into output command selector/controller and key detector/controller 41. When data is to be returned to the controller, answer waveform selector/conditioner 42 develops the appropriate signal for transmission over the data bus to the controller. Composite signals appearing on the bus are received in circuit 40, where the composite signals are continually counted to determine the address of the transponder being signalled from the controller. A plurality of address switches 50 are preset in a certain code to identify the particular transponder in which the switches are physically positioned. Output conductors 43–49 thus indicate the state (open or closed) of seven on-off switches (not shown) within address switch circuit 50 and circuit 40 continually compares this address with the address denoted by the incoming pulses from bus 21,22. With seven switches a total of 128 addresses can be preset, but of course other numbers of switches can be utilized depending upon the number of transponders to be coupled in a single system. When the circuit 40 recognizes that the address on the bus is that of this specific transponder, the output circuit provides a respond select signal over line 51 to the answer waveform selector/conditioner circuit 42 when lows are present and provides a command select signal over iine 52 to circuit 41 when the highs are present. The signals on lines 51 and 52 are thus enabling signals to effectively enable the associated circuits 41, 42 to accomplish the commands sent and/or to return the data requested in the composite signal during the time that this specific transponder's address is valid. Among other functions, circuit 42 develops the waveforms of FIG. 5 and selects the particular one that is sent back to the controller during each of the pulse lows of a composite signal.

Figure 6:
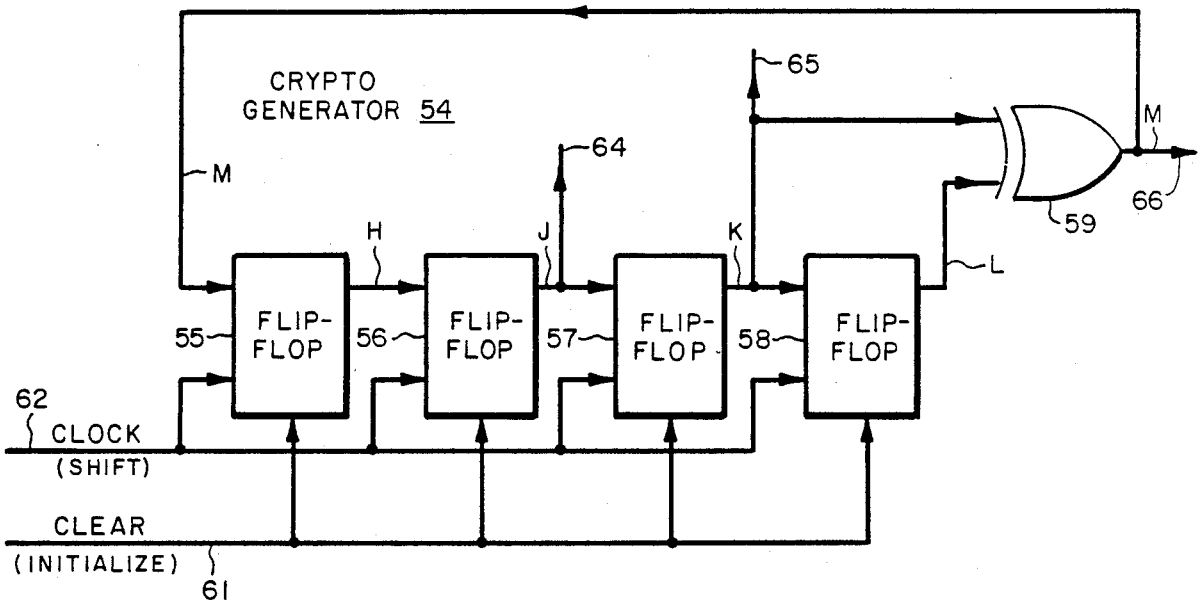
FIG. 6 is a more detailed block diagram representation, with an accompanying state table, of a portion of the transponder shown in FIG. 4; and, FIG. 7 graphically illustrates the operation of a portion of the transponder.

In order to understand the manner in which the coded or encrypted data is produced at a transponder during time segments E, F and G of FIG. 3 for transmission back to the controller, attention is directed to FIG. 6 which shows the details of the crypto generator 54 of FIG. 4, along with a state diagram or table illustrating the generator's operation. Those skilled in the art will appreciate that, in order to obtain a higher degree of security, a more complicated encryption generator would be required to replace the one shown in FIG. 6, where the illustrated circuit is intended only to show the concept of the invention here. The four flip-flops 55, 56, 57 and 58 and the exclusive OR circuit 59 are interconnected in conventional fashion to provide a well-known shift register/counter. Flip-flops 55–58 are initialized or cleared by pulses applied over line 61 from circuit 41. After initialization, clock pulses are applied over line 62 to shift or advance the register through its counting cycle. As the clock pulses are applied to the flip-flops, their outputs switch between a relatively low (logic 0) binary output state and a relatively high (logic 1) binary output state, as indicated by the table in FIG. 6. The changing binary states, at the outputs indicated by the five letter designations H, J, K, L and M in the crypto generator 54 in FIG. 6, are illustrated by the five columns in the table, each of which columns is headed by a corresponding letter designation. To explain, in response to the first seven clock pulses applied to the shift register the output binary state of, for example, flip-flop 57 will be logic 0 for the first three clock pulses, logic 1 for the next three clock pulses, and then back to logic 0 for the seventh pulse, as shown by the column headed by the letter K. The five binary output signals H, J, K, L and M are thus pseudo-random in nature. Of course, the degree of randomness may be increased as desired by adding more complexity to the crypto generator. Moreover, the clock pulses may be randomized so that they occur in a random pattern. For example, the transponders may be addressed at random and the crypto generator at any given transponder may receive a clock pulse only every nth time the transponder recognizes its address. Three lines 64, 65 and 66 connect the outputs of flip-flop 56, flip-flop 57 and exclusive OR circuit 59, respectively, to circuit 42 to provide the circuit with the J, K, and M binary output signals.

During the time segment in which the low-amplitude pulse E (FIG. 3) is transmitted from the controller 20 over the data bus 21, 22, the addressed transponder answers or responds by returning coded identifying data representing an encrypted signature of the transponder. This is accomplished in circuit 42 (FIG. 4) by employing the binary output signal M to determine the specific manner in which the low pulse E is modified and returned to the controller. At any given time, binary signal M at the addressed transponder will be established at either its 0 or 1 level. During the low pulse E, circuit 42 operates under control of that binary signal and actuates the transponder's switch S2 as necessary to produce selected ones of the waveforms P–W in FIG. 5 for transmission back to the controller. In the illustrated embodiment of the invention, whenever binary signal M is established at its logic 0 level waveform Q will be developed, by operating the addressed transponder's switch S2, for return over data bus 21, 22 to the controller. On the other hand, if signal M is at its logic 1 level, waveform V will be generated and transmitted back to the controller. Obviously, the selection of waveform Q for logic 0 and waveform V for logic 1 is arbitrary and those logic levels could be employed to generate any of the other waveforms in FIG. 5.

Thus, when a transponder is addressed either waveform Q or waveform V will appear in segment E and this represents an encrypted signature of the transponder which changes from time to time depending on the binary state of binary signal M during each segment E. The random changing pattern, between logic 0 and 1, of signal M may be considered a predetermined secret code schedule in accordance with which the coded data, namely the encrypted signature, changes. As indicated by block 28 in the controller 20 (FIG. 1), the controller includes decrypting or decoding means which operates in accordance and in step with the same predetermined secret code schedule to decode the received coded identifying data and decrypt the signature in order to determine the validity of the replying transponder. A corresponding crypto generator in the controller would be operated, or stepped through its counting cycle, in synchronism with the crypto generator at the transponder so that when waveform Q, for example, is produced during a particular segment E by a responding valid transponder, the controller will "know" that the received waveform Q indicates that the answering transponder is valid. The receipt at the controller of any waveform other than waveform Q constitutes invalid data and signifies that the transponder is either malfunctioning or is phoney or bogus. An alarm may be immediately produced to alert operating personnel that an unauthorized person or burglar may be attempting to compromise the security of the system by substituting a valid transponder with a bogus transponder or with a computer.

The coded data transmitted from the addressed transponder during each of the low pulses or time segments F and G (FIG. 3) represents information concerning some condition or state associated with the transponder. Preferably, the coded data relates to the state of a transducer monitored by the transponder. In the absence of decoding the coded transducer data, the information found on line 21, 22 will not reveal, to the unauthorized person, the transducer state.

More particularly, the transducer comprises the monitored switch contacts or switch 71 in FIG. 4 which can be established in either a normal position or an alarm position. The switch can be internal to the transponder or external, such as a switch contact set positioned adjacent to a door or window, which contact set is separated upon movement of one part relative to another. Alternatively, the switch 71 can represent a detector for particles of combustion, or any other transducer of the types alluded to previously. The status of switch contacts 71 is monitored by switch state determination circuit 72 and presented to output latches 73 and 74. When the switch 71 is found to be in its normal position, indicating that nothing is wrong, latch 73 is operated, whereas if the switch has been established in its alarm position, signifying that there is an alarm state, latch 74 is actuated. In the prior system, the operation of latch 73 would cause circuit 42 to select a particular one of the waveforms P–W of FIG. 5 for transmission back to the controller over data bus 21, 22, while the operation of latch 74 would cause circuit 42 to select a different one of the waveforms P–W for return to the controller. The selected waveforms were always the same. In other words, a normal state of switch 71 would always result in the same waveform selected from those in FIG. 5, and an alarm state would also always result in the same waveform selected from FIG. 5 but different than the one chosen to represent normal conditions.

In accordance with a salient feature of the invention, the switch data representing the monitored contacts 71 is returned to the controller during each of the low pulses F and G in coded or encrypted form to thwart an unauthorized person attempting to defeat the security of the system. Observation of the data appearing on line or bus 21, 22 during a segment F or a segment G provides no hint or clue whatsoever regarding the state of the sensed transducer. With the transducer data on line 21, 22 in coded form, the unauthorized person (such as a burglar or robber) will not know whether he tripped an alarm or not, or whether an alarm has been initiated by someone else. For example, if a "silent" alarm has been actuated, the person cannot intercept any useful information from the line 21, 22 and will not know if law enforcement personnel had been dispatched. The switch is effectively read twice and switch data is sent to the controller during both segments F and G to obtain confirmation and to help eliminate false alarms.

Figure 7:
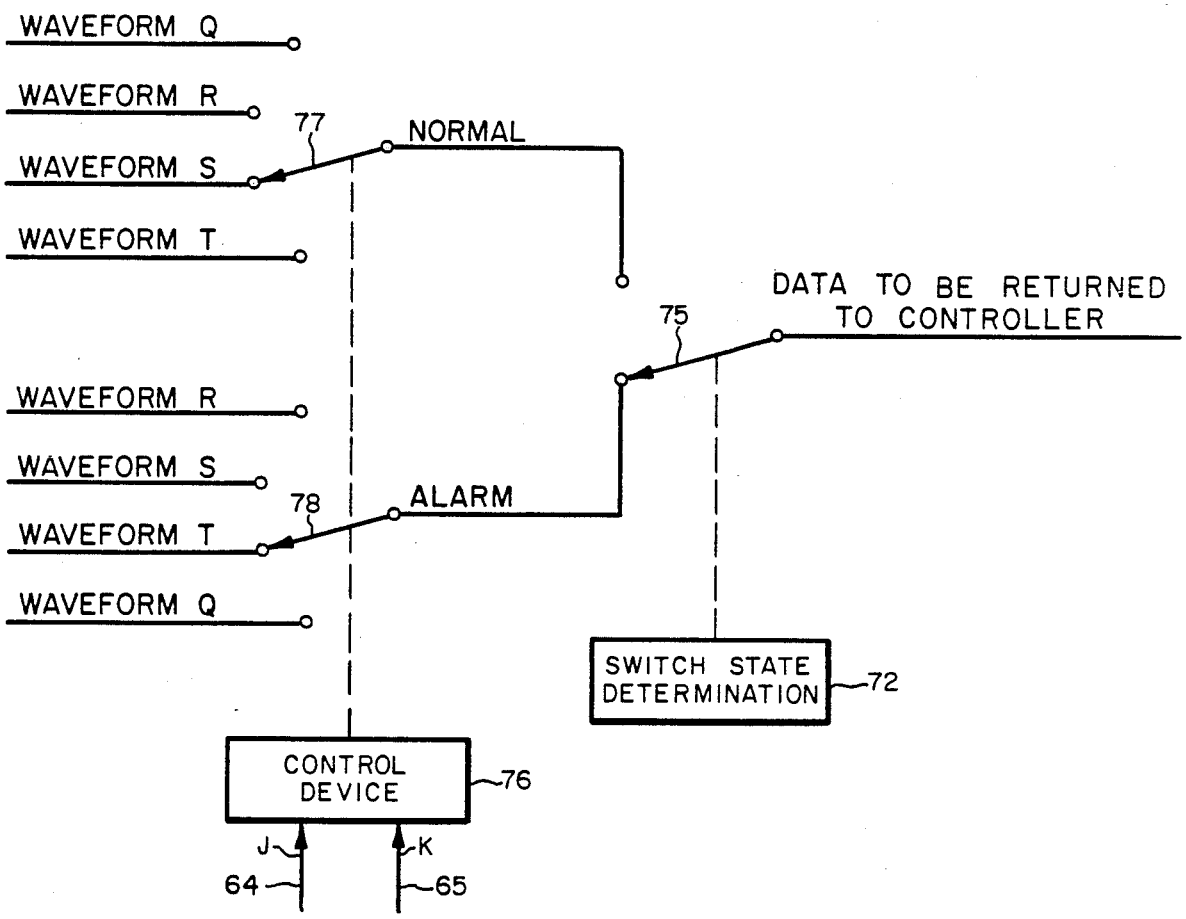

To achieve encrypting of the switch data in accordance with the illustrated embodiment of the invention, circuit 42 is designed to function in the manner graphically illustrated in FIG. 7. Pointer 75 is positioned by latches 73 and 74, under the control of switch state determination circuit 72, and selects whether the coded data returned to the controller represents a normal position of switch 71 or an alarm position. Control device 76 functions under the control of the binary signals J and K from the crypto generator 54 to position the pointers 77 and 78, whih are effectively tied together and move in unison. The table at the bottom of FIG. 7 illustrates the operation. Specifically, when binary signals J and K are both at their logic 0 levels, pointers 77 and 78 will be at their uppermost positions so that waveform Q will be chosen as the coded data to represent the normal condition of switch 71 and waveform R will be selected as the coded data to represent the alarm condition of the switch. If binary signal K then changes to logic 1, while signal J remains at logic 0, pointers 77 and 78 are moved counterclockwise one position so that waveform R will represent the normal switch position and waveform S the alarm position. In similar fashion, with signals J and K at their logic 1 and 0 levels, respectively, waveform S is selected by pointer 77 to indicate a normal switch 71 and waveform T is chosen by pointer 78 to signify an alarmed switch. Finally, if both of the binary signals J and K are at their logic 1 levels pointers 77 and 78 will be moved to their lowermost positions to select waveform T as the coded form representing a normal switch and waveform Q as the coded form reflecting an alarmed switch.

Hence, during a pulse low F or G any one of waveforms Q, R, S or T will appear at random and there is no correlation or relationship between waveforms and conditions of switch 71. At some times waveform R, for example, is returned to the controller to indicate that switch 71 is normal, while at other times the same waveform R is sent back to the controller to indicate that an alarm has been tripped. This totally frustrates the unauthorized person since no useful information can be derived off of the line 21, 22, thus preventing the person from knowing whether an alarm has been triggered.

Since the same crypto generator at the transponder controls the formation of both the encrypted signature during low pulse E and the encrypted switch data during low pulses F and G, decoding or decrypting of the switch data may also be accomplished at the controller by means of block 28 (FIG. 1). The changing binary states of signals J and K effectively provide a code schedule in accordance with which the switch data during low pulses F and G is coded.

While a particular embodiment of the invention has been shown and described, modifications may be made, and it is intended in the appended claims to cover all such modifications as may fall within the true spirit and scope of the invention.

I claim:

1. A security system including a controller for receiving data over a pair of line conductors from a plurality of addressable transponders monitored by the controller and coupled across the line conductors within the same building structure, at least one of the transponders comprising encrypting means, operable when the transponder is addressed by the controller, for sending to the controller coded data the form of which varies from time to time in accordance with a predetermined secret code schedule, wherein the controller includes decrypting means which operates in accordance and in step with the same predetermined secret code schedule to decode the received coded data, wherein said coded data includes coded identifying data representing an encrypted signature of the addressed transponder, which signature may change each time the coded data changes, and wherein the decrypting means decodes the coded identifying data and decrypts the signature in order to determine the validity of the replying transponder.

2. A security system according to claim 1 wherein the coded data also includes coded transducer information and represents the state of a transducer associated with the addressed transponder, and wherein the decrypting means decodes the coded transducer information to determine the state of the transducer.

3. A security system according to claim 1 wherein each of the time segments of the composite signal includes a pulse, and wherein the coded data is provided by changing a characteristic of the pulse during the selected time segment.

4. A security system according to claim 3 wherein the waveshape of the pulse is changed during the selected time segment to provide the coded data.

5. A security system for a single protected building enclosure and including a pair of line conductors, a controller for transmitting data over the line conductors, and plurality of addressable transponders each of which is located within the building enclosure and is coupled across the conductors to receive the transmitted data and, when addressed, modifies the transmitted data and returns the modified data back to the controller, at least part of the returned data being produced by encrypting means in the addressed transponder, the returned encrypted data varying from time to time in accordance with a code schedule to represent coded information, and wherein the controller includes decrypting means which operates in accordance and in step with the same code schedule to decrypt the coded information, wherein said coded data includes coded identifying data representing an encrypted signature of the addressed transponder, which signature may change each time the coded data changes, and wherein the decrypting means decodes the coded identifying data and decrypts the signature in order to determine the validity of the replying transponder.

6. A security system including a controller for receiving data over a pair of line conductors from a plurality of individually addressable transponders connected across the line and located within the same protected premise, each of the transponders comprising a base and a cover assembled to form an enclosure, encrypting means within said enclosure, operable when the transponder is addressed for sending coded identifying data back to the controller, which coded identifying data represents an encrypted signature of the addressed transponder and may be changed from time to time, wherein the controller includes decrypting means for decoding the coded identifying data and decrypting the signature to determine the validity of the replying transponder, said base and cover including means for establishing an electrical connection when the base and cover are mated, to identify separation of the base and cover by interruption of the electrical connection, said means for establishing the electrical connection between the base and cover including at least one cylindrical female connector defining as slit therein and supported on the base, and a flag-like connector supported on the cover in a position such that when the cover and base are assembled, the flag-like connector is received in the slit of the cylindrical female connector to provide both mechanical indexing and retention, and effective electrical contact.

7. A security system as claimed in claim 6 in which said controller is connected to transmit a pulse signal, having a plurality of pulses, over the pair of line conductors to the plurality of individually addressable transponders, wherein each of the transponders, when addressed, replies to the controller by selectively modifying at least a portion of one of the received pulses, such that the coded identifying data is returned to the controller in the form of a modified pulse representing the encrypted signature of the replying transponder, which identifying data may be changed by modifying the pulse differently from time to time when the transponder is addressed.

8. A security system for a single physical enclosure and including a pair of line conductors, a controller for transmitting data over the line conductors, and a plurality of addressable transponders each of which is located within the protected premise and is coupled across the conductors to receive the transmitted data and, when addressed, modifies the transmitted data and returns the modified data back to the controller, at least part of the returned data being produced by encrypting means in the addressed transponder and representing an encrypted signature of the transponder, which signature is unique and is changed from time to time in accordance with a secret code schedule, and wherein the controller includes decrypting means which reads the returned data and operates in accordance with the same secret code schedule to decrypt the encrypted signature to determine the validity of the replying transponder.

9. A security system according to claim 8 wherein additional data, transmitted from the controller to the addressed transponder, is modified in response to, and under the control of, a transducer associated with the transponder to provide coded transducer data which is returned to the controller, and wherein the decrypting means decodes the coded transducer data to determine the state of the transducer.

10. A security system for a single physical enclosure and having a controller for sending successive composite signals each divided into time segments representing different data and further including address information, and a plurality of addressable transponders, each having an individual address, located within the single physical enclosure and a single local multiplex loop coupling all the transponders to the controller, to receive the composite signals and to recognize both the individual transponder address and the different data in a composite signal, each transponder comprising means operative, when a transponder is addressed and during a particular time segment of a composite signal, to return to the controller coded identifying data which represents an encrypted signature and is subject to change each time the transponder is addressed, and which coded data are read and decoded at the controller to decrypt the signature thereby to determine the validity of the replying transponder.

11. A security system including a controller for receiving data over a pair of line conductors from a plurality of individually addressable transponders connected across the line and located within the same protected premise, each of the transponders comprising a base and a cover assembled to form an enclosure, encrypting means within said enclosure, operable when the transponder is addressed to send coded identifying data back to the controller, which coded identifying data represents an encrypted signature of the addressed transponder and may be changed from time to time, wherein the controller includes decrypting means for decoding the coded identifying data and decrypting the signature to determine the validity of the replying transponder, said base and cover including means for establishing an electrical connection when the base and cover are mated, enabling the controller to identify separation of the base and cover by interruption of the electrical connection.

* * * * *